US008727248B2

(12) United States Patent
Galanty

(10) Patent No.: US 8,727,248 B2
(45) Date of Patent: May 20, 2014

(54) COMMINUTOR WITH SCREENING CONDITIONER

(76) Inventor: William Galanty, Short Hills, NJ (US)

( * ) Notice: Subject to any disclaimer, the term of this patent is extended or adjusted under 35 U.S.C. 154(b) by 410 days.

(21) Appl. No.: 13/207,792

(22) Filed: Aug. 11, 2011

(65) Prior Publication Data

US 2012/0037740 A1 Feb. 16, 2012

Related U.S. Application Data

(60) Provisional application No. 61/372,633, filed on Aug. 11, 2010.

(51) Int. Cl.
*B02C 23/36* (2006.01)

(52) U.S. Cl.
USPC ..... 241/46.06; 241/89.2; 241/89.3; 241/243; 241/291

(58) Field of Classification Search
USPC ..... 241/243, 46.06, 291, 89.2, 89.3; 210/386, 391, 407
See application file for complete search history.

(56) References Cited

U.S. PATENT DOCUMENTS

| | | | |
|---|---|---|---|
| 2,103,896 | A | 12/1937 | Doyle et al. |
| 2,241,587 | A | 5/1941 | Durdin, Jr. |
| 2,292,901 | A | 8/1942 | Schmitz, Jr. |
| 2,305,935 | A | 12/1942 | Thom |
| 2,342,927 | A | 2/1944 | Durdin, Jr. |
| 2,594,785 | A | 4/1952 | Meeker |
| 2,648,365 | A | 8/1953 | Lacout |
| 2,672,985 | A | 3/1954 | Nordell |
| 2,894,697 | A | 7/1959 | Panning et al. |
| 2,903,193 | A | 9/1959 | Anderson |
| 2,921,683 | A | 1/1960 | Strenz et al. |
| 3,396,914 | A | 8/1968 | Liebman |
| 3,596,842 | A | 8/1971 | Barber |
| 4,120,457 | A | 10/1978 | Link |
| 4,166,583 | A | 9/1979 | Ruckstuhl |
| 4,186,888 | A | 2/1980 | Galanty |
| 4,418,873 | A | 12/1983 | Lutz et al. |
| 4,491,278 | A | 1/1985 | Galanty |
| 4,637,557 | A | 1/1987 | Vitunac |
| 4,919,346 | A | 4/1990 | Chambers, Sr. |
| 4,961,540 | A | 10/1990 | Wiesemann |
| 4,966,689 | A | 10/1990 | Wark et al. |
| 5,061,380 | A | 10/1991 | Stevenson |
| 5,150,844 | A | 9/1992 | McKie |
| 5,186,401 | A | 2/1993 | Herdman et al. |
| 5,275,342 | A | 1/1994 | Galanty |
| 5,320,286 | A | 6/1994 | Chambers, Sr. et al. |
| 5,406,865 | A | 4/1995 | Galanty |
| 5,490,922 | A | 2/1996 | Gresa |
| 5,505,388 | A | 4/1996 | Chambers et al. |
| 5,609,307 | A | 3/1997 | Rota |
| 5,628,467 | A | 5/1997 | Graveman |

(Continued)

*Primary Examiner* — Mark Rosenbaum
(74) *Attorney, Agent, or Firm* — Greenberg Traurig, LLP

(57) ABSTRACT

A comminutor for shredding rag-like materials includes a frame member having a cutter bar that is affixed thereto and has a plurality of cutter teeth, and includes screen bars aligned with the cutter teeth. Each of the screen bars has an end that fits closely to its adjacent cutter tooth and the frame member so as to close a gap between the cutter tooth and the frame member. The end of the screen bar may include a flange that fits closely to the frame member and a tab proximate to the flange that fits closely to the cutter tooth. In an embodiment where the cutter tooth is flush with the frame member, the end of the screen bar includes a flange that fits closely to both frame member and the cutter tooth.

18 Claims, 6 Drawing Sheets

(56) References Cited

U.S. PATENT DOCUMENTS

| | | | |
|---|---|---|---|
| 5,833,152 | A | 11/1998 | Galanty |
| 5,915,636 | A | 6/1999 | Caballero |
| 6,176,443 | B1 | 1/2001 | Boyd et al. |
| 6,241,170 | B1 | 6/2001 | St. Clair |
| RE37,349 | E | 9/2001 | Chambers, Sr. et al. |
| 6,311,905 | B1 | 11/2001 | Galanty et al. |
| 6,330,982 | B1 | 12/2001 | Yu et al. |
| 6,332,984 | B1 | 12/2001 | Boyd et al. |
| 6,830,207 | B2 | 12/2004 | Galanty et al. |
| 6,938,845 | B2 | 9/2005 | Galanty |

COMMINUTOR WITH SCREENING CONDITIONER

CROSS-REFERENCE TO RELATED APPLICATION

The present application claims priority from U.S. Provisional Patent Application No. 61/372,633, filed on Aug. 11, 2010.

FIELD OF THE INVENTION

The field of the invention relates to a comminutor for wastewater treatment, more particularly, to a comminutor for size reduction of rag-like and string-like solids in the waste stream.

BACKGROUND OF THE INVENTION

The recent introduction of "flushable" wipes and similar rag-like solids into sanitary waste streams in high volumes has had a severe impact on the operability of wastewater treatment systems, creating a need for improved methods of handling these new materials at such facilities. Due to their high mechanical strength, these materials do not shred easily, and can readily become lodged in wastewater treatment piping and equipment. Additionally, when subjected to the turbulent action of flow, these materials can be woven into large "mops," further increasing their resistance to shredding, thereby making them even more difficult to process. Fabric wastes such as flushable wipes also tend to wrap and accumulate on pumps and other rotating equipment, such as comminutors, as well as accumulating in pipe interiors. This impedes wastewater flow, and causes other operational difficulties in wastewater treatment facilities, necessitating downtime for digester clean-outs, de-ragging of pump impellers, and other maintenance.

SUMMARY OF THE INVENTION

Certain embodiments of the present invention provide a comminutor screen for the size reduction of materials, including "flushable" wipes and similar products, which minimizes the potential for accumulation of rag-like and string-like solids in the comminutor or in downstream equipment. The screen provides a straight-through rotating comminutor design for more effective grinding, cleaner operation, and reduced maintenance. More particularly, stationary cutter bars are arrayed on the screen in such a manner as to avoid formation of gaps, ledges or transitions such that rag-like materials and stringy fragments have no place to wrap on the bar during grinding, Once reduced to sufficiently-small sizes, ground materials are carried cleanly through the screen slots. In some embodiments, gaps between the stationary cutter bars and side supports are spanned by tabs extending from the screen bars. This eliminates gaps on which rag-like or string-like solids might snag. The screen slots are fabricated to be smooth to prevent the formation of crevices on which solids might snag.

In an embodiment, gaps between the stationary cutter bars and the side supports are spanned by extended tabs or bridges formed by notches in the ends of the screen bars. This configuration eliminates spaces on which material can accumulate. The result is a clean operating comminutor that does not require periodic maintenance to clear off the screen.

In another embodiment of the seamless design, the stationary cutter bar is moved closer to the screen, eliminating any space between the cutter bar and screen. The cutter tooth is notched to form an anchor that holds the cutter bar firmly in position on the support frame.

In an embodiment, the screen is removable and replaceable independently of the stationary cutter bar. In an embodiment, the cutter bar is removable independently of the screen.

DETAILED DESCRIPTION OF THE INVENTION

The present invention may be employed in a number of different types of comminutors having differing arrangements of fixed cages or screens for comminuting solid materials carried by liquid (e.g., sewage) flowing in an open channel. For example, the present invention is suitable for use in comminutors fabricated in accordance with the disclosures provided by U.S. Pat. No. 4,186,888 ("the '888 patent"), which is incorporated by reference herein in its entirety. The exemplary embodiments of the present invention presented herein are described in conjunction with a comminutor fabricated in accordance with the disclosures of the '888 patent.

Figure 1:
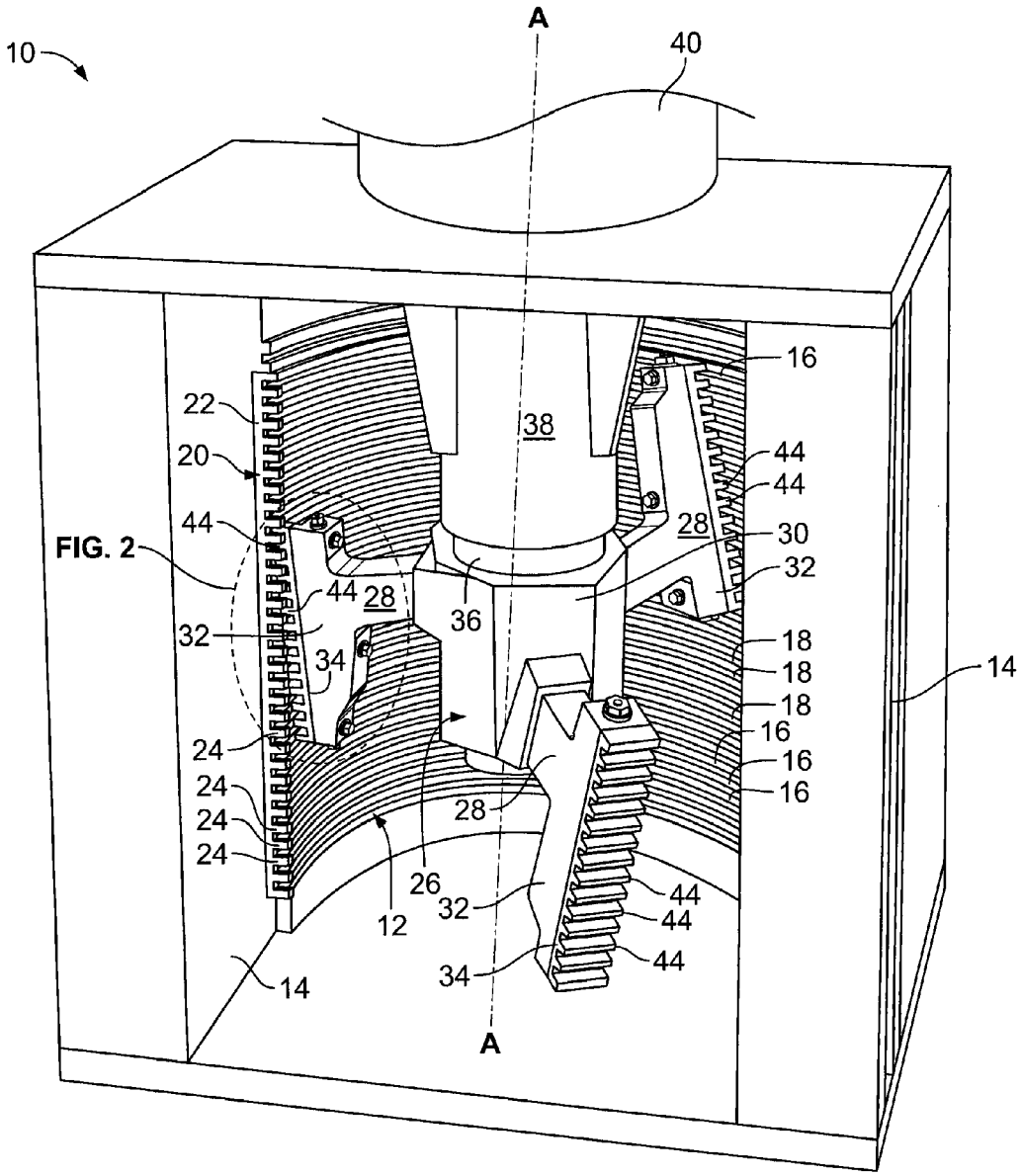
FIG. 1 is a perspective view of a comminutor according to an embodiment of the present invention, the comminutor having a stationary screen, stationary cutter bars, and rotating elements visible in FIG. 1.
Figure 2:
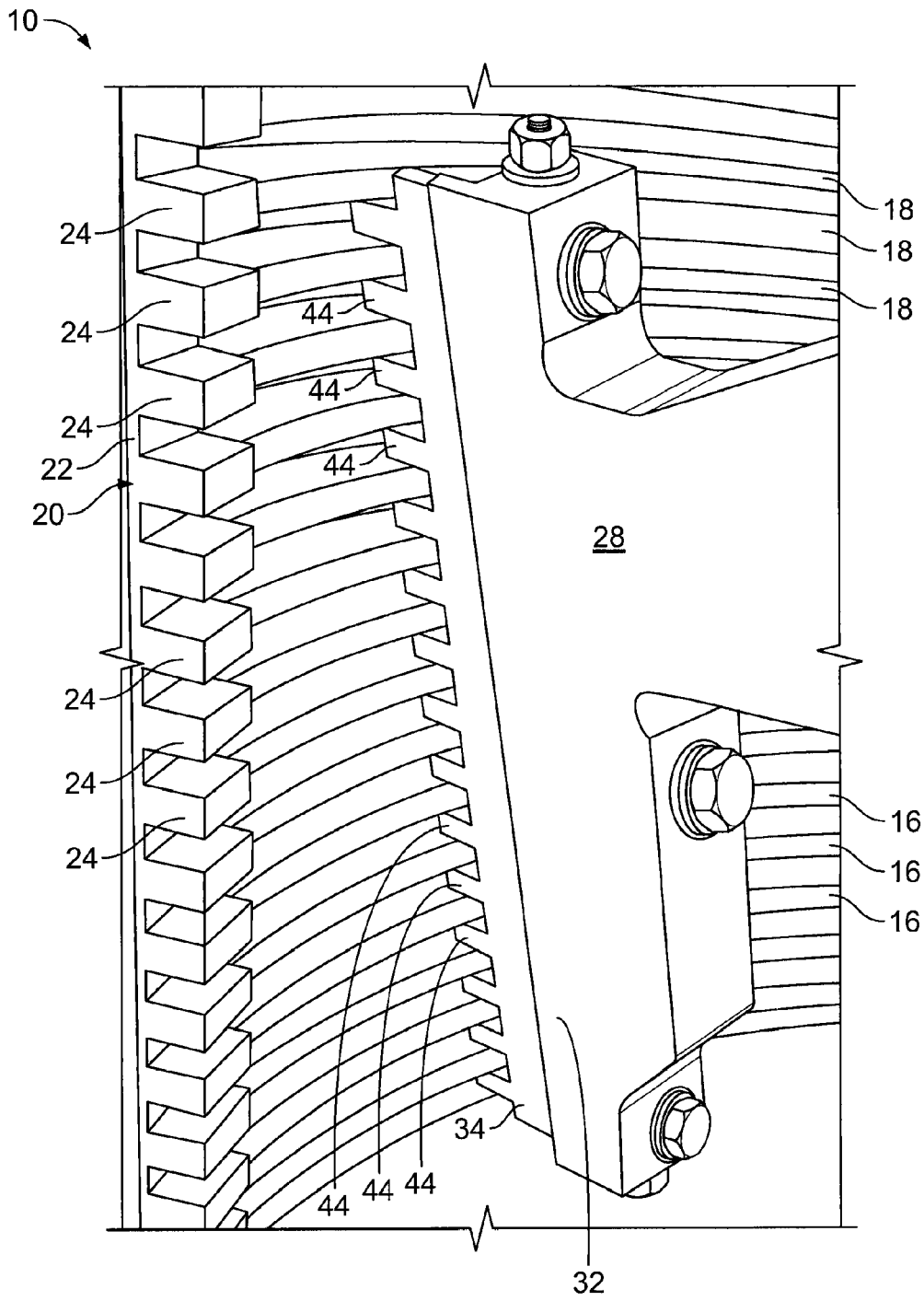
FIG. 2 is an enlarged view of a segment of the comminutor of FIG. 1.

FIGS. 1 through 5 depict a comminutor 10 constructed in accordance with an exemplary embodiment of the present invention. Referring to jointly to FIGS. 1 and 2, the comminutor 10 includes a curved screen 12, concave toward the interior of the comminutor 10. In the present embodiment, the screen 12 has the shape of a semi-circular cylinder having a longitudinal axis of curvature A-A. The screen 12 is supported by frame members 14 and includes a plurality of axially spaced-apart sections of semi-circular screen bars 16, the open spaces between the screen bars 16 being slots 18. The screen bars 16 are supported by frame members 14 and may be removably secured thereto by bolts or other means. A plurality of stationary cutter bars 20 having lateral surfaces 22 are disposed along the frame members 14, and aligned with the axis A-A. The stationary cutter bars 20 have cutter teeth 24 which extend radially beyond the screen bars 16 toward the axis A-A.

The comminutor 10 also includes a rotary cutter wheel 26, comprising a plurality of arms 28 extending radially outward from a hub 30 and fixedly attached thereto, each arm 28 having an end 32 directed away from the hub 30 and a shredding bar 34 removably attached to the end 32. The hub 30 is attached to a rotatable shaft 36, which resides in a bearing housing 38 and which may be attached to a motor 40 capable of causing the shaft 36 and rotary cutter wheel 30 to rotate.

The hub 30 and shaft 36 have a common axis of rotation that coincides with longitudinal axis A-A. Each shredding bar 34 has a plurality of teeth 44 extending away from the hub 30.

Turning to FIG. 2, the rotary cutter wheel 26 (see FIG. 1) is arranged such that the teeth 44 of the shredding bar 34 extend into the slots 18 of the screen 12 in an intermeshing fashion. In operation, teeth 44 of the shredding bars 36 continuously mesh with the slots 18 of the screen 12 to assure that the slots 18 are cleared of solids. The teeth 44 of the shredding bar 32 also intermesh with the teeth 24 of the cutter bars 20, as discussed further with respect to FIG. 3.

Figure 3:
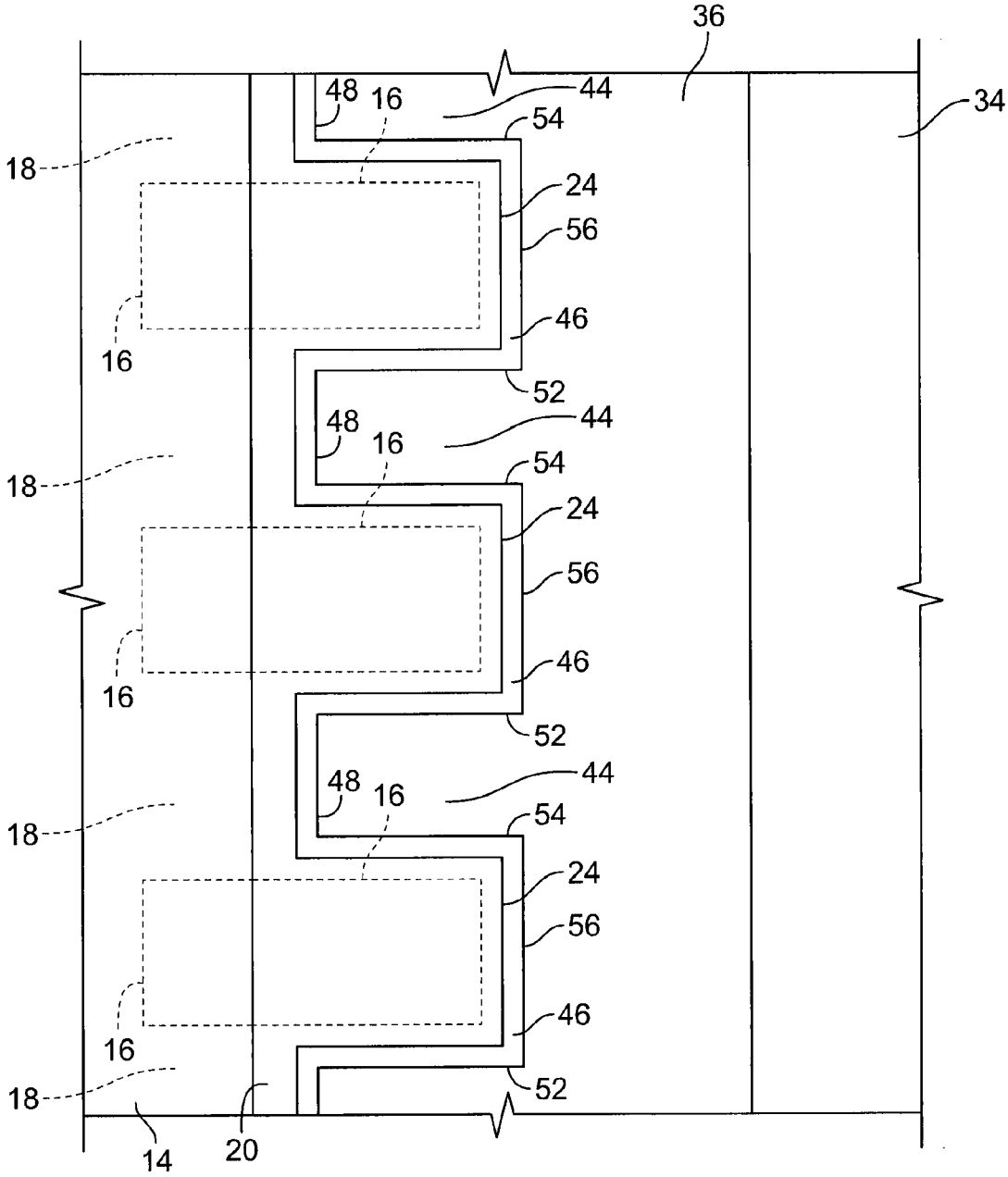
FIG. 3 is a schematic diagram showing relationships among components of the comminutor of FIG. 1.

FIG. 3 is a schematic diagram showing relationships among components of the comminutor of FIG. 1. As illustrated in FIG. 3, the shredding bar 34 has gaps 46 between adjacent teeth 44. The teeth 44 of the shredding bar 34 have tooth ends 48, and opposite tooth surfaces 52, 54. Tooth surfaces 52, 54 of adjacent teeth 44 are connected by a shredding bar surface 56. As previously noted with respect to FIG. 1, the cutter teeth 24 of the stationary cutter bars 20 extend beyond the screen bars 16. The cutter teeth 24 are also thicker than the screen bars 24. The teeth 44 of the shredding bars 34, and the gaps 46 therebetween, are adapted such that they intermesh more closely with the cutter teeth 24 of the stationary cutter bars 20 than they do with the screen bars 16.

Figure 4:
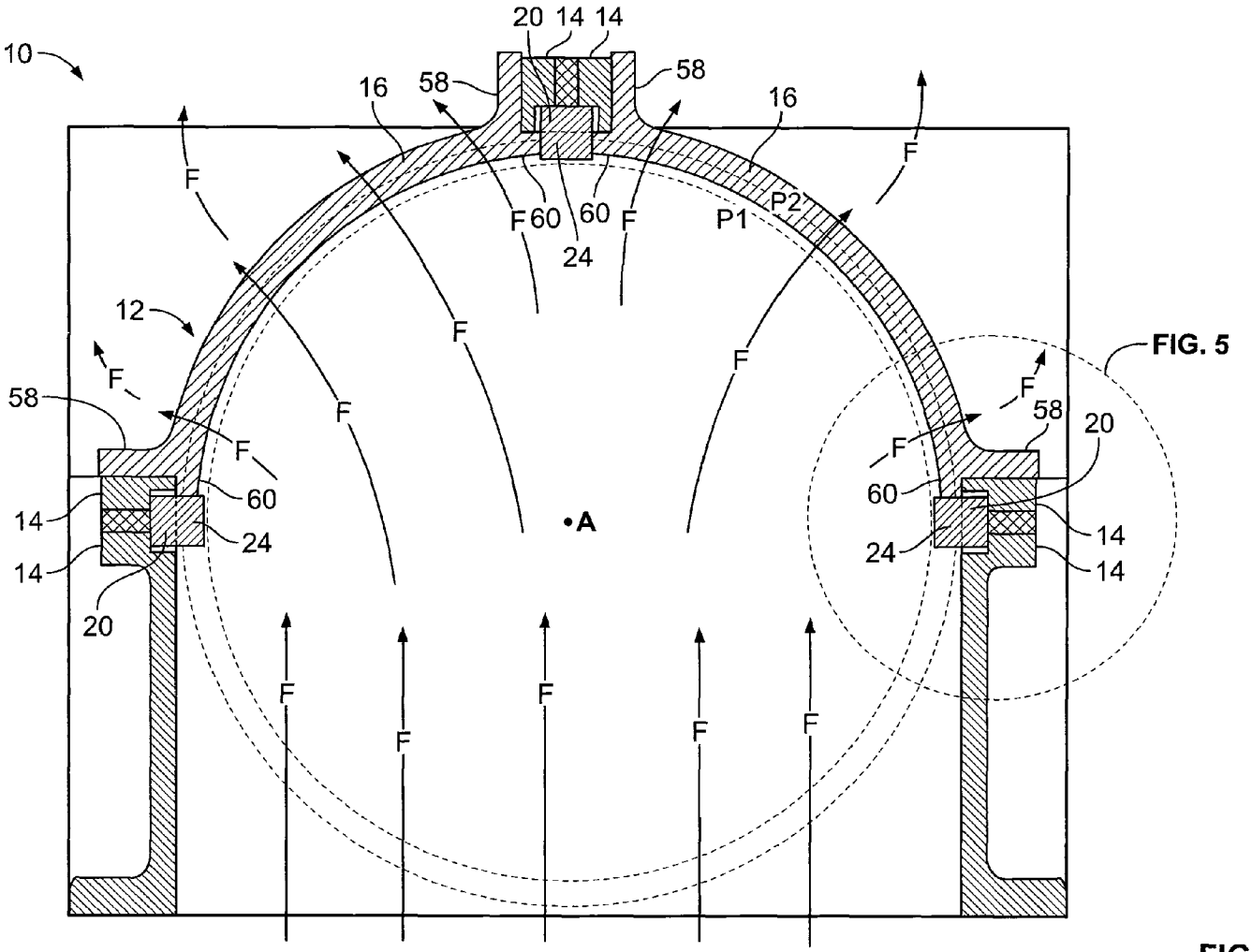
FIG. 4 is a top cross-sectional view of the stationary screen of the comminutor of FIG. 1.

FIG. 4 is a cross-sectional view of the comminutor 10 perpendicular to the axis A-A, looking downward from the top of the comminutor 10. The cross-section is taken through the frame members 14, the cutter teeth 24 and the screen bars 16. FIG. 4 depicts the positioning of the elements of the comminutor 10, without the aforementioned rotary cutter wheel 26 present, and the flow of the open channel fluid flow (e.g., wastewater) therethrough. The circumferential paths of the shredding bar surfaces 56 and the tooth ends 48 of the teeth 44 (not shown in FIG. 4) are depicted by dashed circles P1 and P2, respectively. The direction of the fluid flow through the comminutor is generally denoted by the arrows F. The screen bars 16 have flanged portions 58 which fit closely to or contact the frame members 14 and tabs 60 which fit closely to or contact the teeth 24 of the stationary cutter bars 20, as discussed in more detail with respect to FIG. 5. For the purposes of the present invention, one element closely fits another when gaps between the two elements generally do not exceed about 0.05 inches. In other embodiments, surfaces of the elements may fit flush against each other, with the respective surfaces generally being coextensive.

Figure 5:
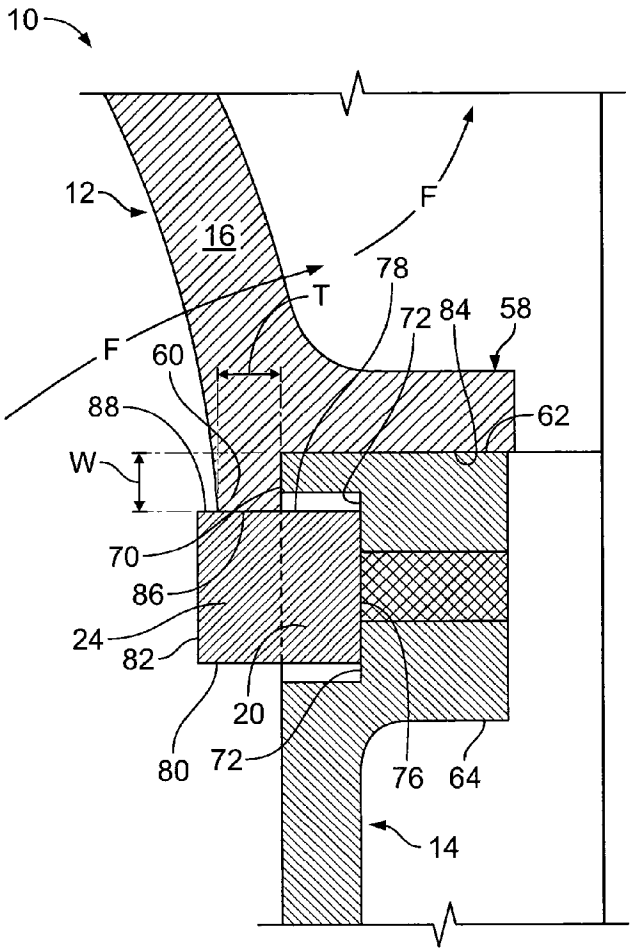
FIG. 5 is an enlarged view of a segment of the stationary screen of FIG. 1 from the same cross-sectional view as in FIG. 4.

FIG. 5 is a detail of FIG. 4 showing the configuration of non-rotating elements of the comminutor 10. More particularly, the frame member 14 has side surfaces 62, 64, and front surfaces 70, 72 facing toward the interior of the comminutor 10. The stationary cutter bars 20 may be removeably fastened to the frame member 14 by suitable fasteners, such as bolts. The cutter tooth 24 has a proximal surface 76 which engages the front surfaces 72, opposite side surfaces 78, 80, and a distal surface 82 facing the interior of the comminutor 10.

The screen bar 16 is retained and supported by the frame member 14. As indicated on FIG. 4, and shown in more detail in the present FIG. 5, a typical screen bar 16 has a flanged section 58 with a flange surface 84 that fits closely to or contacts a side surface 62 of the frame member 14. The flange surface 84 may be generally coextensive with the side surface 62 of the frame member 14 in an axial direction perpendicular to the axis A-A (not shown). The typical screen bar 16 also has a tab 60 which is proximate to the flanged section 58 and has a thickness T, width W, and a tab surface 86. The tab surface 86 closely fits or contacts side surface 78 of the cutter tooth 26 and may be generally coextensive with the side surface 78 of the cutter tooth 26 in the axial direction. The thickness T and width W of the tab 60 are dimensioned to bridge or close any gaps or spaces that might otherwise exist between the screen bar 16 and the cutter tooth 26 and/or the screen bar 16 and the frame member 14. However, a portion 88 of the side surface 78 may be exposed in some embodiments of the present invention.

In some embodiments of the present invention, the flange 58 may be affixed to the rest of the screen bar 16 by welding or some other technique. In other embodiments, the flange 58 is integral with the rest of the screen bar 16. The tab 60 maybe an extension of, and, therefore, integral with the screen bar 16.

Figure 6:
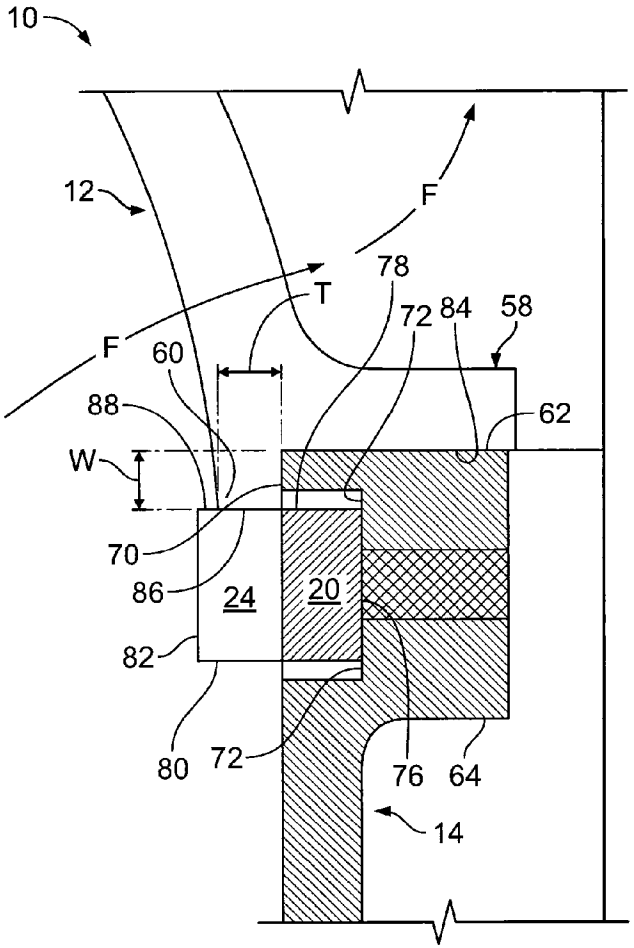
FIG. 6 is an enlarged view of the segment of the stationary screen of FIG. 1 according to another top cross-sectional view.

FIG. 6 is a top cross-sectional view of the screen segment of FIG. 5, with the cross-section taken between adjacent screen bars 16 and above the cutter tooth 24. Reference numbers in FIG. 6 correspond to the same elements designated by those reference numbers in FIG. 5. FIG. 5 and FIG. 6, taken together, show that the flange surface 84 and tab surface 86 may remain coextensive with the side surface 62 of the frame member 14 and the side surface 78 of the cutter tooth 24 throughout the thickness of the screen bar 16 along the longitudinal direction of the axis A-A (not shown).

Returning to FIG. 5, the engagement of the tab surface 86 with side surface 78 of the cutter tooth 24 closes any gaps between the cutter tooth 24 and the flange member 14 that might otherwise ensnare rag-like or string-like solids. Further, this arrangement of flange 58 and tab 60 relative to the frame member 14 and cutter tooth 24 reduces or eliminates fluid flow that might otherwise occur between the screen bar 16 and the cutter tooth 24 or frame member 14. The prevention of fluid flow between these elements of the comminutor 10 further inhibits the accumulation of solid particulates that may otherwise make it necessary to frequently disassemble and maintain the screen 12.

Figure 7:
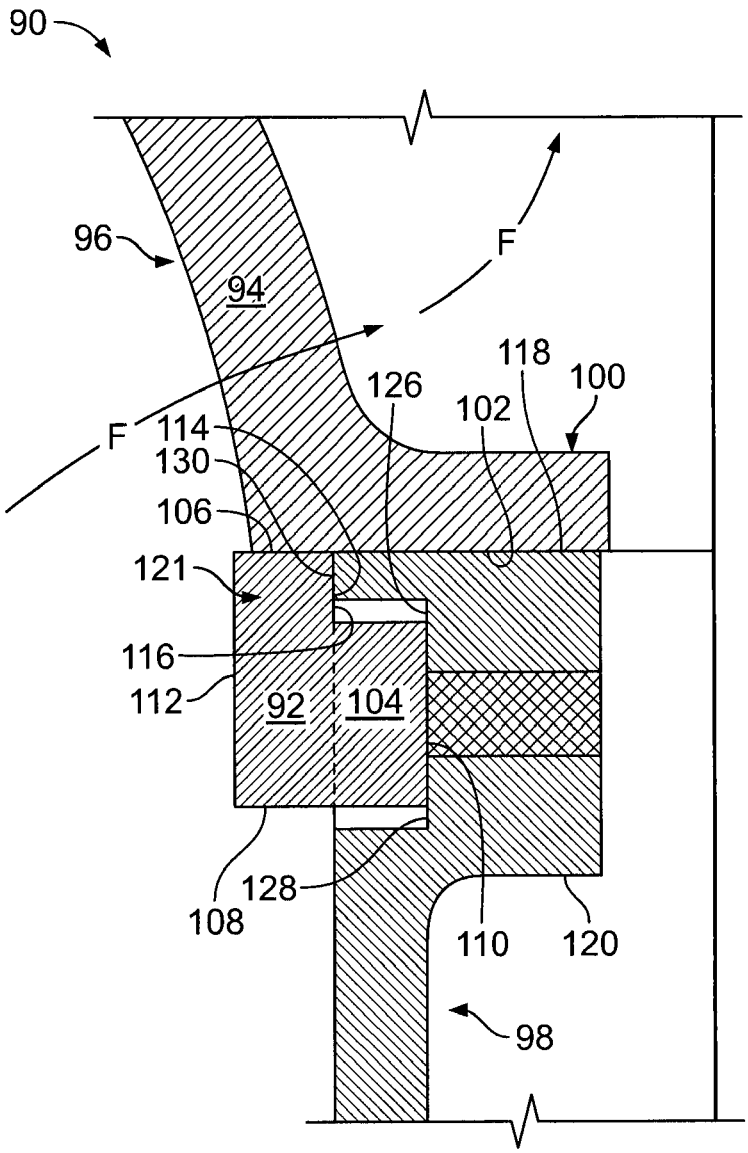
FIG. 7 is an enlarged view a segment of a comminutor screen according to another embodiment of the present invention.

FIG. 7 depicts a portion of a comminutor 90 having an arrangement of a cutter tooth 92 and a screen bar 94 according to another embodiment of the present invention. Unless otherwise stated, the embodiment of FIG. 7 is constructed and assembled in the same basic manner as the embodiment of FIGS. 5 and 6, with similarity of parts being indicated by the similarity of part names, and differences between parts described in FIG. 7 and hereinbelow.

Continuing to refer to FIG. 7, the comminutor 90 includes a screen 96 which has a plurality of screen bars 94 and a frame member 98 that supports and retains the screen 96. A typical screen bar 94 has a flanged section 100 with a flange surface 102. The cutter tooth 92 is formed on a stationary cutter bar 104, and has opposite side surfaces 106, 108, a proximal surface 110 and a distal surface 82 facing the interior of the comminutor 90. Cutter tooth 92 also has a cutter tooth extension 114, such that the cutter tooth extension 114 extends across the side frame 98. Further, the notch 114 forms an auxiliary surface 116 opposite the distal surface 112 of the cutter tooth 92.

The frame member 98 has side surfaces 118, 120, and front surfaces 126, 128, 130 facing toward the interior of the comminutor 10. Front surfaces 126, 128 are engaged by the proximal surface 110 of the cutter tooth 92. Front surface 130 is engaged by the auxiliary surface 116 of the cutter tooth 92. The surface 102 of the flanged section 100 engages the side surface 118 of the frame member 98 and the side surface 106 of the cutter tooth 92.

It should be understood that the embodiments described herein are merely exemplary and that a person skilled in the art may make many variations and modifications without departing from the spirit of the invention. For instance, a portion of the width W of the tab 60 that is closest to the distal surface 82 of the cutter tooth 26 of the embodiment of FIGS. 5 and 6 may be curved or fluted (not shown) towards the distal surface 82 of the cutter tooth 26, so that no portion of the cutter tooth 26 extends beyond the flange 58 of the screen bar 16. In this configuration, the fluted portion of the tab 60 diverts fluid away from the tab 60, thereby further diverting stringy solids away from the intersection between the cutter tooth 26 and the screen bar 16. This further enhances the comminution of stringy solids. Further, the size and shape of the cutter tooth 26 and the screen bar 16 may be varied without departing from the scope of the invention. The aforesaid variations and modifications, as well as others obvious to one skilled in the relevant arts, are intended to be included within the scope of the invention, as exemplified by the claims presented below.

I claim:

1. A comminutor, comprising:

a rotary cutter wheel rotatable about an axis of rotation;

a frame having at least one frame member extending substantially parallel to said axis, said at least one frame member having a first surface facing toward said axis, a second surface opposite said first surface and a third surface extending from said first surface to said second surface;

at least one cutter bar having a plurality of cutter teeth, said at least one cutter bar being affixed to said at least one frame member such that said cutter teeth of said at least one cutter bar extend toward said axis, each of said cutter teeth having a distal surface facing away from said at least one frame member and a side surface extending from said distal surface toward said at least one frame member, said side surface being proximate to said third surface of said at least one frame member; and a plurality of screen bars substantially perpendicular to said at least one frame member and spaced away from each other along the direction of said axis such that each of said screen bars is aligned with a corresponding one of said plurality of cutter teeth, wherein each of said screen bars has an end that fits closely to said third surface of said at least one frame member and said side surface of said corresponding one of said cutter teeth.

2. The comminutor of claim 1, wherein said end of said each of said screen bars has a flange with a flange surface that fits closely to said third surface of said at least one frame member and a tab proximate said flange and having a tab surface that fits closely to said side surface of said corresponding one of said plurality of cutter teeth.

3. The comminutor of claim 2, wherein said flange is welded to said screen bar.

4. The comminutor of claim 2, wherein said flange and said tab are integral to said screen bar.

5. The comminutor of claim 2, wherein said flange surface is coextensive with said third surface of said at least one frame member in a direction substantially perpendicular to the axis and said tab surface is coextensive with said side surface of said corresponding one of said plurality of cutter teeth in the direction substantially perpendicular to the axis.

6. The comminutor of claim 1, wherein said side surface of said corresponding one of said plurality of cutter teeth is substantially coextensive with said third surface of said at least one frame member, said end of said each of said screen bars having a flange with a flange surface that fits closely to said third surface of said at least one frame member and to said side surface of said corresponding one of said plurality of cutter teeth.

7. The comminutor of claim 6, wherein said flange is welded to said screen bar.

8. The comminutor of claim 6, wherein said flange is integral to said screen bar.

9. The comminutor of claim 6, wherein said flange surface is coextensive with said third surface of said at least one frame member and said side surface of said corresponding one of said plurality of cutter teeth in a direction substantially perpendicular to the axis.

10. The comminutor of claim 6, wherein said corresponding one of said plurality of cutter teeth has a proximal surface opposite said distal surface thereof, said proximal surface being closely fitted to said first surface of said at least one frame member.

11. A screen bar for a comminutor having a frame with a frame member having a first surface, a second surface opposite the first surface and a third surface extending from the first surface to the second surface and a cutter bar having a plurality of cutter teeth, the cutter bar being aligned with the frame member and affixed to the first surface thereof such that the plurality of cutter teeth extend away from the first surface, each of the cutter teeth having a distal surface facing away from the frame member and a side surface extending from the distal surface toward the frame member, the side surface being proximate to the third surface of the frame member, said screen bar comprising an end of said screen bar adapted to fit closely to the third surface of the frame member and the side surface of one of the plurality of cutter teeth, wherein said end of said screen bar has a flange with a flange surface adapted to fit closely to the third surface of the frame member and a tab proximate the flange and having a tab surface adapted to fit closely to the side surface of the one of the plurality of cutter teeth with said screen bar substantially perpendicular to the side frame and aligned with the one of the plurality of cutter teeth.

12. The screen bar of claim 11, wherein said flange surface is coextensive with the third surface of the frame member in a direction substantially perpendicular to the frame member and the tab surface is coextensive with the side surface of the one of the plurality of cutter teeth in the direction substantially perpendicular to the frame member with said screen bar substantially perpendicular to the side frame and aligned with the one of the plurality of cutter teeth.

13. The screen bar of claim 11, wherein said flange is welded to said screen bar.

14. The screen bar of claim 11, wherein said flange and said tab are integral with said screen bar.

15. A screen bar for a comminutor having a frame with a frame member having a first surface, a second surface opposite the first surface and a third surface extending from the first surface to the second surface and a cutter bar having a plurality of cutter teeth, the cutter bar being aligned with the frame member and affixed to the first surface thereof such that the plurality of cutter teeth extend away from the first surface, each of the cutter teeth having a distal surface facing away from the frame member and a side surface extending from the distal surface toward the frame member, the side surface being proximate to the third surface of the frame member, said screen bar comprising an end of said screen bar adapted to fit closely to the third surface of the frame member and the side surface of one of the plurality of cutter teeth, wherein the side surface of the one of the cutter teeth is substantially coextensive with the third surface of the frame member, said end of said screen bar having a flange with a flange surface that is adapted to fit closely to the third surface of the frame member and to the side surface of the one of plurality of cutter teeth with said screen bar substantially perpendicular to the side frame and aligned with the one of the plurality of cutter teeth.

16. The screen bar of claim 15, wherein said flange surface is adapted to be coextensive with the third surface of the frame member and the side surface of the one of the plurality of cutter teeth in a direction substantially perpendicular to the frame member with said screen bar substantially perpendicular to the side frame and aligned with the one of the plurality of cutter teeth.

17. The screen bar of claim 15, wherein said flange is welded to said screen bar.

18. The screen bar of claim 15, wherein said flange is integral to said screen bar.

* * * * *